US005286210A

United States Patent [19]

Kilsdonk et al.

[11] Patent Number: 5,286,210

[45] Date of Patent: Feb. 15, 1994

[54] CONNECTOR INTERFACE ASSEMBLY AND METHOD

[75] Inventors: Jan A. Kilsdonk, Corona; Harold J. Toppen, Santa Ynez, both of Calif.; David H. Blyther, Whidbey Island, Wash.

[73] Assignee: McDonnell Douglas Corporation, Long Beach, Calif.

[21] Appl. No.: 930,801

[22] Filed: Aug. 17, 1992

[51] Int. Cl.[5] ..... H01R 13/648; H01R 13/518

[52] U.S. Cl. ..... 439/95; 439/724; 439/638

[58] Field of Search ..... 439/95, 96, 540, 723, 439/724, 97, 101, 108, 92, 638, 639; 361/426

[56] References Cited

U.S. PATENT DOCUMENTS

| | | | |
|---|---|---|---|
| 3,397,384 | 8/1968 | Lawrence | 439/723 |
| 3,471,822 | 10/1969 | Van Baelen | 439/724 |
| 3,597,726 | 8/1971 | Appleton et al. | 439/724 |
| 3,652,977 | 3/1972 | Feldberg | 439/724 |
| 3,825,800 | 7/1974 | Warman et al. | 439/540 |
| 4,527,285 | 7/1985 | Kekas et al. | 439/928 |
| 4,781,604 | 11/1988 | Sadigh-Behzadi et al. | 439/101 |
| 4,906,199 | 3/1990 | Twomey et al. | 439/95 |

FOREIGN PATENT DOCUMENTS

| | | | |
|---|---|---|---|
| 0748595 | 7/1980 | U.S.S.R. | 439/715 |

*Primary Examiner*—Gary F. Paumen

*Attorney, Agent, or Firm*—John P. Scholl

[57] ABSTRACT

A connector interface assembly is disclosed which includes modules which contain electrical terminals of an electrical signal or power source. The assembly also includes a ground plate and a module retainer block having receptacles for removably receiving the modules therein. The retainer block and the ground plate are removably attached to a multi-contact connector. The ground plate has an open area for receiving the multi-contacts of the connector therein, and the retaining block has a cavity for receiving the ground plate therein. The receptacles are positioned at a higher level relative to both the grounding plate and the multi-contact connector in order to facilitate connection of conductors of the electrical source to both the grounding plate and the multi-contact connector. The proximity of the modules to the ground plate and open area of the retainer block allows for minimizing impedance loss due to the use of minimal length ground and signal/-power leads from the module.

21 Claims, 3 Drawing Sheets

CONNECTOR INTERFACE ASSEMBLY AND METHOD

BACKGROUND OF THE INVENTION

The invention relates generally to electrical interface assemblies and, more particularly, to electrical connector interface assemblies which modules for supplying electrical power or an electrical signal to the connector are mounted proximal to both a ground plate and electrical contacts of the connector in order to minimize impedance of the interconnections.

Conventional systems for connecting or dispersing electrical currents to multiple outlets typically include a multi-contact connector such as an Arinc 600 mounted on a line replaceable unit. For typical aircraft applications, the multi-contact connector receives its current source from module blocks which are positioned 8 to 10 feet away. Since the average of 30 module blocks are positioned behind each of these connectors, the total length of wiring therebetween and concomitantly the total impedance thereof is inordinately great. The modules are typically mounted in a single rail structure which has a grounding means for shielded wires as well as for other types of input wires, for example, for a single wire which is adjacent a power cable. However, this grounding requirement results in additional inordinately lengthy cables for connection of the module ground leads to a ground plane. It has been generally believed by those skilled in the art that this grounding requirement consequently precludes a more proximal connection of the modules to the multi-contact connectors.

Various types of electrical junction assemblies have been designed for providing a common electrical connection between a number of separate external conductors. An example of such a prior art assembly is disclosed in U.S. Pat. No. 3,652,977 to Felberg. The Felberg assembly has conductive parts thereof completely enclosed in a structure. The Felberg structure includes sockets mounted on a single conductive plate for electrical interconnection of the sockets and the external conductors which are inserted therein. However, a primary limitation of the Felberg assembly is that it is not capable of being attached to and electrically connected to a plurality of electrical contacts of a plug or socket type of connector.

Some prior art terminal structures have been designed to allow various types of units to be plugged therein. An example of such a prior art structure is disclosed in U.S. Pat. No. 4,527,285 to Kekas. The Kekas structure is adapted to allow modules of particular input units, particular output units, an essential controller and a power supply for the other functional units to be mounted in a suitable frame. The Kekas structure includes a power distribution substrate which is electrically connected to each functional unit mounted in the frame. However, a primary limitation of the Kekas structure is that it does not have a grounding means incorporated therein and is also not designed to be pluggable into a multiple contact connector.

Some prior art block assemblies have been specifically designed to improve the interconnections between plug connector or terminals plugged into the block. An example of such a connector assembly is disclosed in U.S. Pat. No. 3,597,726 to Appleton. The Appleton device includes an S-shaped conducting structure which interconnects female sockets in a terminal block connector. However, a primary limitation of the Appleton device is that it cannot, by itself, interconnect a multiple contact connector with a ground plane and an electrical signal or power source.

What is needed is a module connector integrated with a grounding means and a block connector which is attachable to a multi-contact connector for interfacing the multi-contact connector with a ground and an electrical signal or power source. What is also needed is such an integrated structure which minimizes ground lead lengths from the module to the ground and jumper lead lengths from the module to contact points of the multi-contact connector in order to minimize impedance of the leads. Such an integrated structure is also needed that can attach the structure to the multi-contact connector so as to minimize the length of electrical cable associated therewith.

SUMMARY OF THE INVENTION

It is a principal object of the present invention to provide an electrical interface assembly between a multiple contact connector, electrical power or signal terminals and a ground means.

It is another object of the present invention to provide an electrical interface assembly which minimizes the length of cable interconnections between a multiple contact connector, an electrical power or signal terminal and a ground means.

It is also an object of the present invention to provide an electrical interface assembly which integrates an electrical power or signal terminal block with a grounding means.

It is also an object of the present invention to provide an electrical interface assembly which is mounted directly on a multiple contact connector.

It is also an object of the present invention to provide an electrical interface assembly for a multiple contact connector, an electrical power or signal source terminal module and a grounding plate which allows for selective inter-connections therebetween.

It is also an object of the present invention to provide an electrical interface assembly in which the electrical power or signal source terminal module may be removably inserted into the assembly.

It is also another object of the present invention to provide an electrical interface assembly having an electrical power or signal terminal module in which the electrical conductors thereof are retained in positive electrical contact with an interconnector in the module.

It is finally another object of the present invention to provide a connector interface assembly which is lightweight and compact.

The interface assembly of the present invention essentially provides a structure which reduces the total length of wires otherwise needed to connect a multiple contact connector to a grounding means and to an electrical signal source or power source. Reduction of the weight of the electrical wiring used in the total electrical system can result in significant weight savings of the entire system. This is particularly advantageous in aircraft applications wherein the electrical systems are complex and may require extensive grounding connections. In addition, the reduction of the total length of electrical wiring can also significantly reduce the total impedance of the wiring system and therefore result in an electrical system having significantly lower power losses and thereby generally higher efficiency.

The assembly of the present invention includes a module retainer block which is mounted on the rear portion of a multiple contact connector such as, for example, an Arinc 600 or 404 rectangular connector. In addition, the assembly also includes a shield grounding block which is also mounted on the rear portion of the multiple contact connector. The shield grounding block is the subject of U.S. Pat. No. 4,906,199 to Twomey which is incorporated herein by reference. The module retainer block has a plurality of receptacles therein which receive modules connectors. The modules are provided with retainer clips which allow the modules to be securely positioned in the receptacles. A recess at the receptacles allows the disengagement of the retainer clips and enables the modules to be selectively removed therefrom. The modules are preferable electrically connected to an electrical power or signal source. The modules include terminals electrically connected to wires from the electrical signal or power source, and the terminals are electrically interconnected in the module by means of a suitable bus bar. Sockets are also mounted in the module and connected to the bus bar, and the sockets receive jumper wires therein for connection of the electrical power/signal source to the multiple contacts of the connector.

In addition, ground shield leads from the wires of the electrical power/signal source are connected to a ground plate mounted on the retainer block. The ground plate is a part of the shield grounding block. The receptacles of the retainer block are at a different level than both the grounding plate and an open area (or cavity) of the retainer block into which the multiple contacts of the connector are inserted. This higher level configuration of the receptacles makes the modules as well as the leads coming therefrom more easily accessible. This higher level configuration which provides generally vertical (rather than horizontal) separation of the components thereof also enables the retainer block construction to be more narrow and more compact while providing component separation needed for effective connection and disconnection of the leads and wires between the components and the multiple contact connector. The higher level of the receptacles also enables and facilitates the discernment of the multiple contacts of the connectors from other connections of the assembly. Thus, positioning the receptacles at a higher level, i.e., at a greater distance from the ground plate and open area/multiple contact portion of the connector facilitates jumper wire and ground lead connection to the appropriate multiple contacts (either pins or sockets) and ground plate.

The module is also provided with a retainer which engages a ridge structure on the conductor. This allows the electrical conductor to not only be retained in the module but also provides for secure positioning of the conductor in positive contact with the bus bar socket. Consequently, this retainer/ridge structure minimizes any likelihood of arcing between the conductor and its socket.

As is evident from the foregoing, the conductors from the electrical power/signal source, the ground plate and the multiple contacts of the connector are all positioned generally proximal to each other. Consequently, the jumper cables used to interconnect the modules to the signal/power pin or socket contacts of the connector are relatively short in comparison to the cables of more conventional assemblies. In addition, the ground leads from the conductors inserted in the modules to the grounding plate are also relatively short in comparison to conventional methods which mount the modules on a common rail and individually connect the modules therefrom to a suitable ground. In addition to the weight savings provided by the wire length reduction and the reduced impedance advantage discussed hereinabove, the assembly of the present invention also obviates the likelihood of tangled wires which would make repairs of wiring and electrical units associated therewith more difficult, as in prior art assemblies.

DETAILED DESCRIPTION OF THE PREFERRED EMBODIMENT

Figure 1:
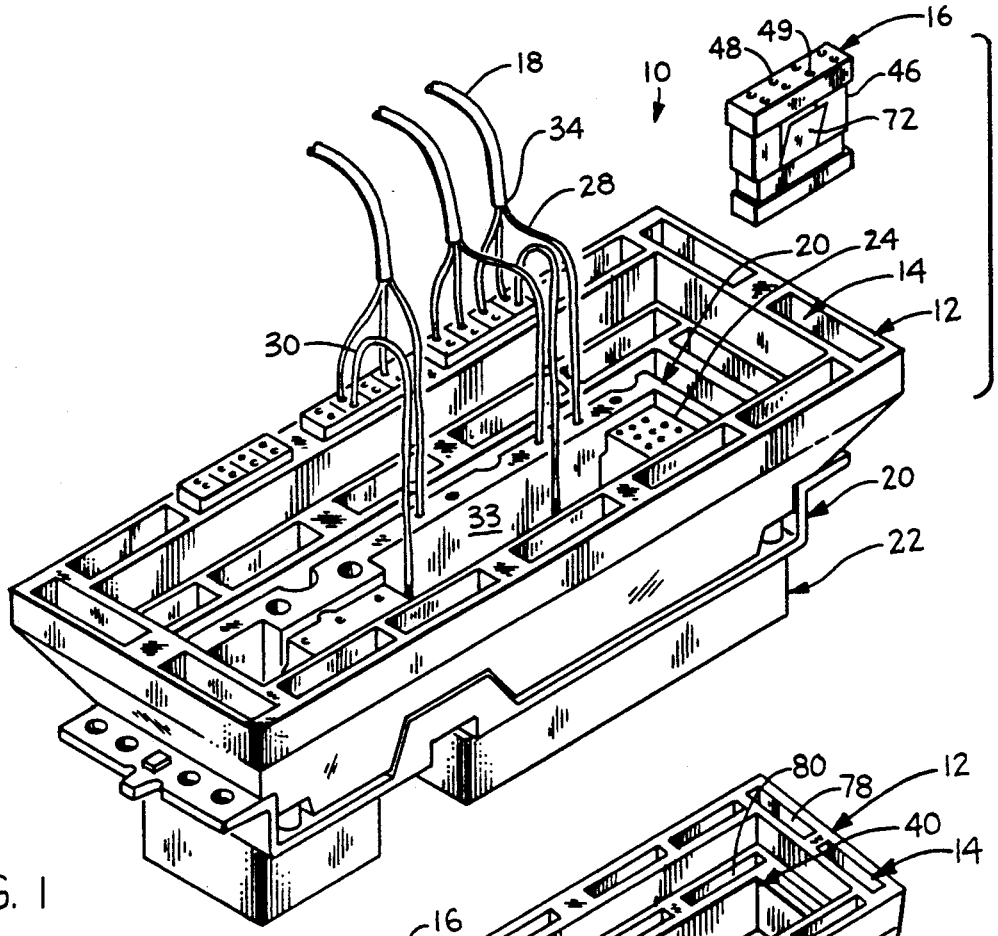
FIG. 1 is an isometric view of the assembly of the present invention showing electrical wire connections thereof.

Referring now to the drawings, the connector interface assembly is generally designated by the numeral 10. The assembly 10 preferably includes a retainer block 12 having a plurality of receptacles 14 for receiving modules 16. Modules 16 preferably include terminal junctions of electrical conductors or wires 18 leading from an electrical power or electrical signal source (not shown). Although electrical wires 18 may conduct either electrical power or an electrical signal, for simplicity they will be referred to hereinafter as electrical power wires 18. The modules 16 are preferably generally plugged into the receptacles 14 which are arranged preferably at generally the periphery 19 of the retainer block 12, as shown. Essentially, modules 16 function to provide a means for connecting the source wires 18 to the block 12. Preferably, the receptacles are also positioned in two or more rows of receptacles at the periphery or outer portion 19 of the retainer block 12, as shown.

The assembly 10 preferably also includes a ground plate or block 20. Ground plate 20 is preferably simply positioned adjacent inner portions of the retainer block 12. Alternatively, however, plate 20 may be attached or connected to block 12 or may be integral therewith. Retainer block 12 and ground block 20 are preferably mounted on multi-contact connector 22. Connector 22 preferably supplies electrical power and/or an electrical signal to other electrical units. Connector 22 may, for example, in aircraft applications be an avionic bay connector (such as an Arinc 600) electrically connected to the aircraft black boxes. Connector 22 preferably includes a portion 24 which has multiple electrical contacts 26 mounted therein. The multiple contacts 26 may be either contact pins or sockets depending on the particular requirements of the electrical system in which the assembly 10 is used.

The electrical wires 18 preferably have shield grounding connections with ground leads 28 attached to the wires 18 and leading therefrom. The ground leads 28 preferably ground the shields 34 of the electrical wires 18 preferably by connection of the leads 28 to ground apertures 32 of the ground plate 20. Thus, as shown in FIG. 1, the direct connection of the ground leads 28 to the ground plate 20 provides a direct, simple and relatively short path for grounding of the wires 18. Since the receptacles 14 are generally arranged at or proximal to the periphery 19 of the ground plate 20, the ground path from the shields 34 of the wires 18 is generally minimized allowing for reduced impedance of the ground leads 28. Minimizing the length of the ground leads 28 also reduces the aggregate weight of the wires used in the electrical system.

Figure 2:
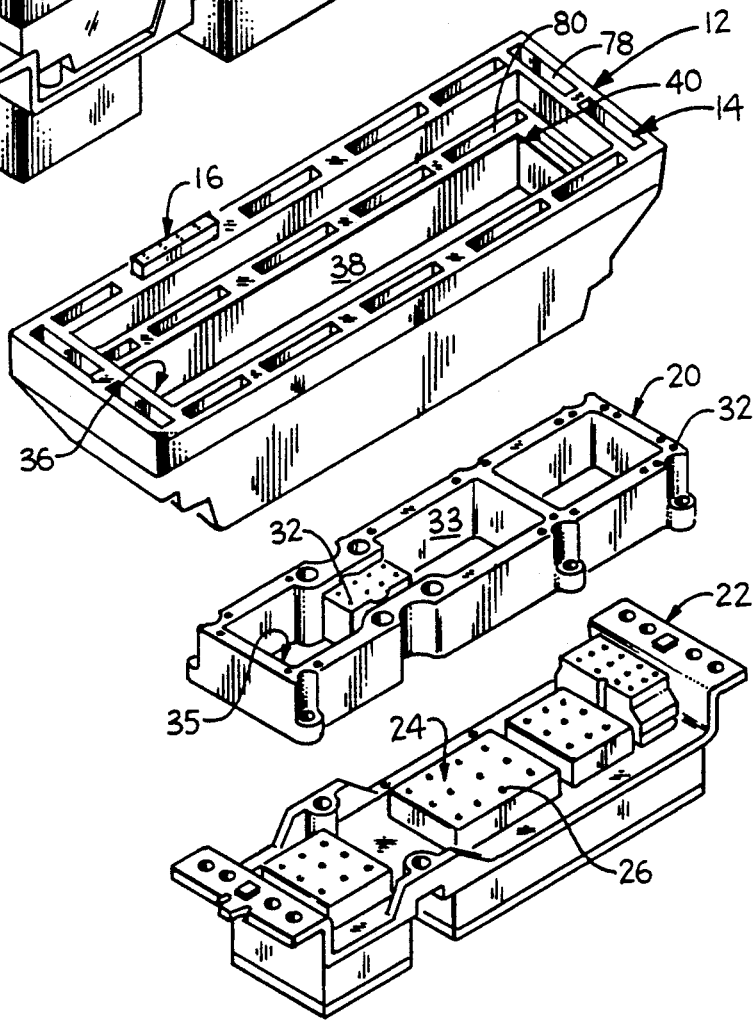
FIG. 2 is a partially exploded isometric view of the retainer block, module, and ground plate of the assembly in mating alignment with a multiple contact connector.
Figure 3:
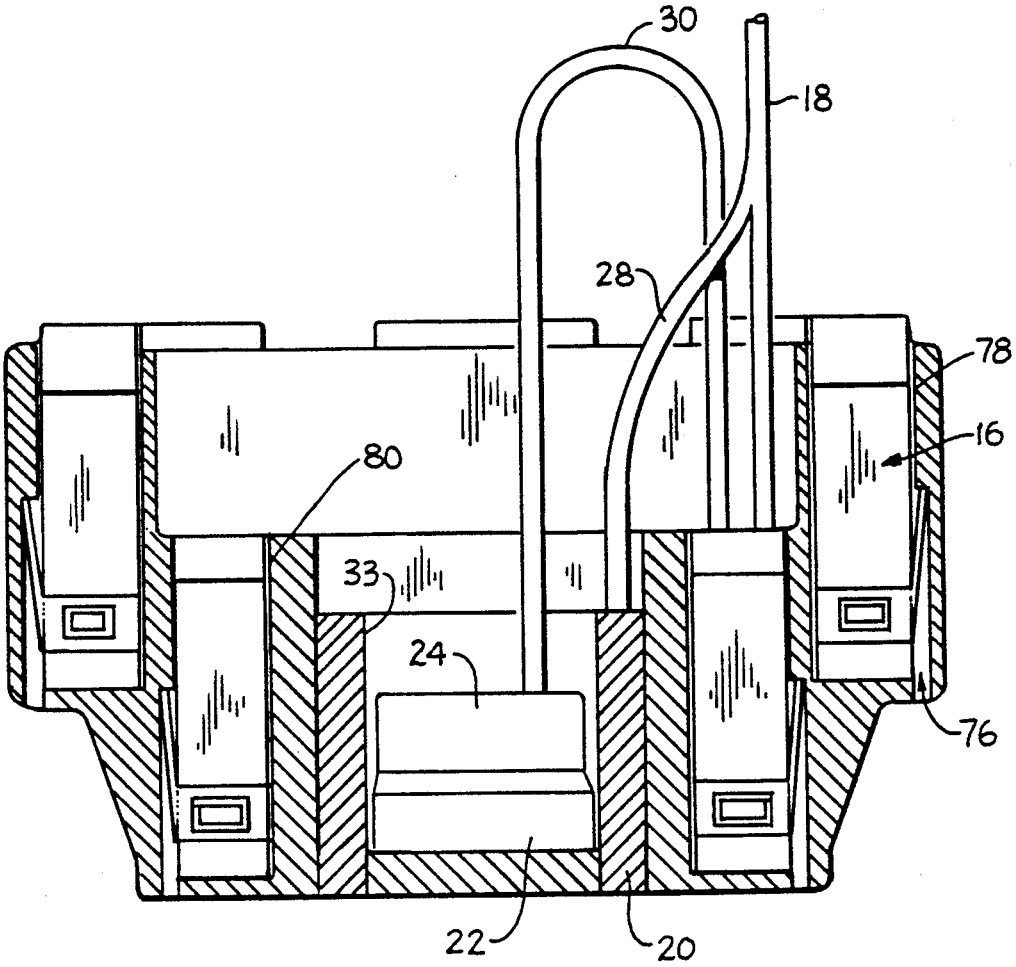
FIG. 3 is an elevated side view of the assembly of the invention mounted on a multiple contact connector and illustrating the electrical conductor, ground lead and jumper wire connections thereof.
Figure 5B:
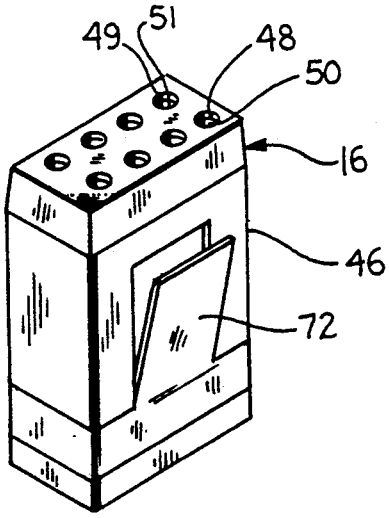
FIG. 5B is a perspective view of the module of the assembly of the present invention showing the retainer structure mounted on the main body of the module.
Figure 5A:
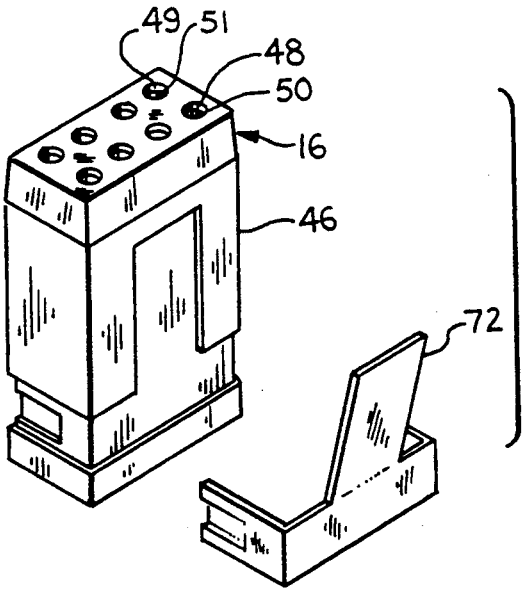
FIG. 5A is a perspective view of the module of the assembly of the present invention showing the retainer clip separated from the main body of the module.

The ground plate 20 preferably has walls 33 defining an open area 35 at preferably a generally central portion thereof, and retainer block 12 also preferably has walls 38 at preferably a generally central portion 40 of the block 12. The walls 38 preferably generally define a cavity 36 of the block 12. When the ground plate 20 is mounted on the connector 22, the cavity open area 35 receives the multiple contact portion 24 of the connector 22 therein. In addition, when the retainer block 12 and plate 20 are mounted on the connector 22, the ground plate 20 is positioned generally adjacent and within the walls 38 and generally surrounding the portion 24 so that the cavity 36 more preferably receives both the ground plate 20 and contact portion 24 therein. This particular positioning of the cavity 38 at a central portion 40 of the retainer block and this positioning of the receptacles at the periphery of this open area as well as at the periphery of the ground plate 20 allows the use of the jumper wires 30 for connection of the electrical terminals 42 of the electrical wires 18 (which are inserted in the modules 16) to the contacts 26 of the connector 22. Since the contacts 26 are located in the open area 36 of retainer block 12 (when block 12 and plate 20 are mounted on connector 22) and are therefore generally proximal to modules 16, the length of the jumper conductors or wires 30 interconnecting the modules 16 to the contacts 26 are minimal and greatly reduced in comparison to prior art assemblies. Due to the minimal length of the jumper wires 30, both the impedance and weight of the jumper wires 30 are minimal, and, consequently, the weight of the entire electrical system of the aircraft is substantially reduced. The electrical jumper wires or conductors 30 preferably have male pin terminals or connectors 44 at each end as shown in FIG. 2. Alternatively, however, jumper wires 30 may have sockets rather than pins at one end in order to accommodate the connector contacts 26 which may be generally pin type of contacts.

Retainer block 12 and ground plate 20 are preferably generally rectangular in shape. In addition, the receptacles 14 are preferably generally at a higher level than the ground plate 20 as well as the cavity 36. Moreover, the receptacles 14 preferably include two or more rows of receptacles 14 with an outer row 78 (proximal the periphery of the retainer block 12) preferably at a higher level than an inner row 80 (proximal the cavity walls 38). Consequently, when the block 12 and plate 20 are mounted on connector 22, the receptacles 14 are preferably at a higher level i.e., at a greater distance from the multiple contact portion 24 of connector 22 and the ground plate 20, with outer row 78 at a greater distance from the contact portion 24 (and plate 20) than inner row 80. This facilitates the discernment of the various electrical connections to and from the multiple contact portion 24, the ground plate 20 and the module 16. In addition, this positioning of the receptacles 14 at different levels facilitates removal and installation of the modules from their receptacles 14 by making the modules generally more prominent than other nearby structures and thus more easily accessible than other parts of the assembly 10.

Figure 4:
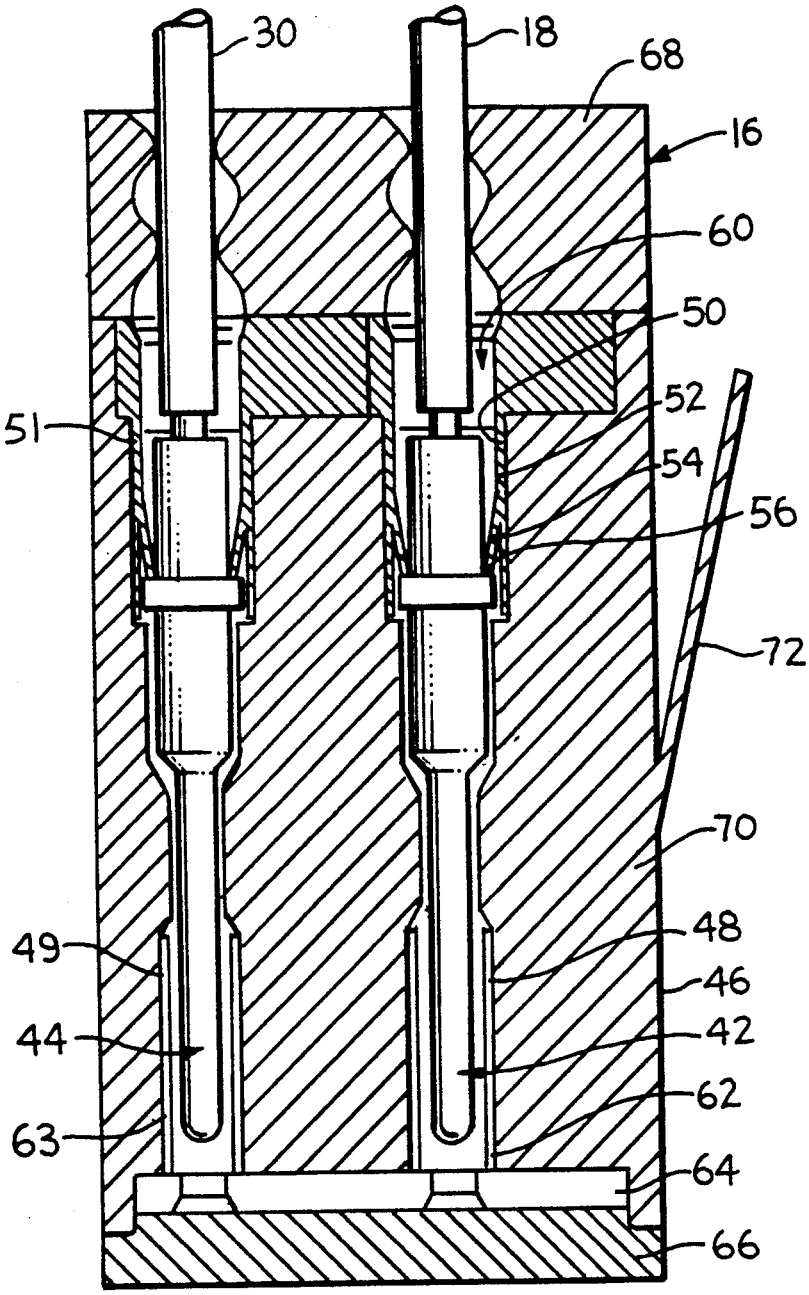
FIG. 4 is an elevated sectional view of the module of the assembly of the invention showing an electrical conductor inserted in a socket of the module.

FIG. 4 shows the module 16 in more detail. Module 16 preferably includes a module housing 46, a first electrical contact (preferably a socket) 48, a second electrical contact (preferably a socket) 49, a socket aperture 50 into which the socket 48 is inserted and a socket aperture 51 into which socket 49 is inserted. The socket apertures 50 and 51 have walls 52 from which extend module terminal or conductor retainer members 54. Members 54 are preferably positioned adjacent (or attached to) the walls 52 at preferably an upper portion of the members 54 with preferably the lower portion thereof extending generally inwardly from the walls 52 in order to generally engage the shoulders 56 of electrical terminals or pin connectors 42 and 44. Thus, the retainer members 54 when in engagement with shoulders 56 securely retain the pins 42 and 44 in a desired position of positive electrical contact with the sockets 48 and 49. The retainer members 54 in conjunction with shoulders 56 thereby both provide and ensure positive electrical connection between the pins 42 and 44 and sockets 48 and 49. A retainer plate 58 is preferably secured to an upper portion of the module housing 46 and is mounted adjacent upper edge portions of retainer members 54 in order to generally retain members 54 in the housing 46. The retainer plate 58 preferably has an aperture 60 through which the electrical wire 18 and 30 can pass for insertion of the terminals 42 and 44 into the sockets 48 and 49. The socket 48 is preferably electrically connected at a lower end 62 to a bus bar 64 and socket 49 is preferably electrically connected at a lower end 63 to bus bar 64. The bus bar 64 preferably electrically interconnects all or simply just a desired number of the sockets 48 and 49 together. More preferably, at least one first socket 48 is interconnected to at least one second socket 49. First socket 48 allows the electrical wire 18 to be connected thereto and second socket 49 allows the jumper wire 30 to be connected thereto and thereby enables jumper wire 30 to interconnect the power source wire 18 to the contacts 26 of the connector 22. Housing 46 is also preferably provided with a bottom cover plate 66 and a grommet 68 at the top portion thereof to generally protect the sockets and terminals from environmental contamination. The module housing 46 is preferably also provided with an insulator 70 which is preferably of unitary construction to electrically insulate both preferably spring sockets 48 and 49 and the electrical terminals 42 and 44.

The module housing 46 preferably also includes a module retainer member or clip 72 attached at a preferably lower portion thereof to the housing 46 and extending outwardly at an upper portion thereof from the housing 46 in order to generally engage a ridge 74 in the retainer block 12. Retainer block 12 preferably also includes a recess 76 which is at least partly defined by the ridge 74. Recess 76 enables insertion of a suitable tool therein to move the retainer member 72 against the module housing 46, thereby disengaging the member 72 from the ridge 74 and allowing removal of the module 16 from the receptacle 14. Although the module 16 has been described as containing sockets 48 and 49, it may alternatively contain conductor pins instead or in addition to the sockets 48 and 49. The generally positive contact between the terminals or conductors 42 and 44 and the sockets 48 and 49 provided by the retainer member 54/shoulders 56 structures by preventing vertical movement of conductors 42 and 44 relative to sockets 48 and 49 generally tends to prevent arcing at the connection otherwise produced by vibration of the vehicle or other structure in which the assembly 10 is installed. The multi-contact connector 22 is typically electrically connected and attached to a line replaceable unit (not shown). In typical modern aircraft applications, the multi-contact connector 22 is an avionic bay connector for a black box, in the back of which are exposed wires which tend to give very large impedances to the electrical system. In such aircraft applications, the assembly 10 supplies electrical power and/or electrical signal to the multi-contact connector 22 which then transmits this power or signal to the black box and from there to other aircraft components.

Accordingly, there has been provided, in accordance with the invention, a connector interface assembly and method for interfacing an electrical power or signal source with a ground plate and a multi-contact connector that fully satisfies the objectives set forth above. It is to be understood that all terms used herein are descriptive rather than limiting. Although the invention has been described in conjunction with the specific embodiment set forth above, many alternative embodiments, modifications and variations will be apparent to those skilled in the art in light of the disclosure set forth herein. Accordingly, it is intended to include also its alternatives, embodiments, modifications and variations that fall within the spirit and scope of the invention as set forth in the claims hereinbelow.

What is claimed is:

1. A connector interface assembly, comprising:

a module retainer block for mounting on a connector, said block having a central portion, said block having at least one recptacle therein, said at least one receptacle positioned between a peripheral portion of said block and said central portion;

a module housing for insertion into said at least one receptacle;

at least one first electrical contact mounted in said module housing for electrical connection of a conductor thereto, said at least one receptacle positioned at a different level than said central portion in a direction of orientation of said conductor when said conductor is electrically connected to said at least one first electrical contact;

a bus bar mounted in said module housing, said bar electrically connected to said at least one electrical contact;

a grounding means for grounding the conductor thereto.

2. The assembly of claim 1 wherein said module housing includes a module retainer for retaining said housing in said at least one receptacle.

3. The assembly of claim 2 wherein said module retainer includes a module retainer member extending outwardly from said housing for engaging inner walls of said at least one receptacle.

4. The assembly of claim 3 further including a means for disengaging said module retainer from said receptacle in order to allow removal of said module housing from said block.

5. The assembly of claim 1 further including a conductor retainer, said conductor retainer including a conductor retainer member extending inwardly from socket walls defining a socket aperture for engaging the conductor at a shoulder portion thereof.

6. The assembly of claim 1 wherein said retainer block includes walls generally defining a cavity for receiving electrical terminals of the connector therein in order to allow electrical connection of the electrical terminals to said at least one first contact of said module housing.

7. The assembly of claim 1 further including at least one second electrical contact mounted in said module housing, said at least one second contact electrically connected to said bus bar for electrically interconnecting said at least one first contact and electrical terminals of the connector.

8. The assembly of claim 1 wherein said grounding means includes a ground plate for electrical connection thereof to the conductor, said ground plate positioned proximal to said block.

9. The assembly of claim 8 wherein said at least one receptacle is positioned generally at a different level than said ground plate in order to facilitate electrical connection between the conductor, the connector and said ground plate.

10. A connector interface assembly, comprising:

a module retainer block for mounting on a connector, said block having walls defining a cavity for receiving electrical terminals of the connector therein, said block having at least two receptacles therein;

at least two module housings for insertion into said at least two receptacles;

a first electrical contact mounted in one of said at least two module housings for electrical connection of a conductor thereto, one of said at least two receptacles positioned at a different level than the other of said at least two receptacles in a direction of orientation parallel to the direction of insertion of said first electrical contact into said one module housing;

a bus bar mounted in said one module housing and electrically connected to said first contact.

11. The assembly of claim 10 further including a second electrical contact mounted in said one of said at least two module housings and electrically connected to said bar for electrical interconnection of said at least one first contact and electrical terminals of the connector.

12. The assembly of claim 10 wherein said one of said receptacles is located at said walls and said other of said receptacles is located at a peripheral portion of said block.

13. A connector interface assembly, comprising:

a module retainer block for mounting on a connector, said block having at least one receptacle therein, said block having walls defining a cavity, said at least one receptacle positioned generally between a peripheral portion of said block and said walls;

a module housing for insertion into the at least one receptacle;

a plurality of first electrical sockets mounted in said module housing for receiving electrical conductors therein;

a bus bar mounted in a lower portion of said module housing, said bus bar electrically connected to said plurality of sockets;

a conductor retainer mounted at an upper portion of said module for retaining the conductors in said electrical socket;

a ground plate mounted on said retainer block, said ground plate generally positioned at the walls and generally within the cavity.

14. The assembly of claim 13 wherein said ground plate includes an open area for receiving an electrical terminal portion of the connector.

15. The assembly of claim 13 wherein said at least one receptacle is mounted at the walls.

16. The assembly of claim 13 wherein said at least one receptacle is positioned generally at a different level than the walls to facilitate electrical interconnection of the electrical conductors and electrical terminals of the connector.

17. The assembly of claim 13 wherein said at least one receptacle is positioned generally at a different level than said ground plate in order to facilitate ground connection of the electrical conductor to said ground plate.

18. The assembly of claim 13 further including a plurality of second electrical sockets mounted in said module housing and electrically connected to said bus bar for electrically interconnecting said plurality of first sockets and electrical terminals of the connector.

19. A connector interface assembly, comprising:

a module housing for insertion into said at least one receptacle;

a module retainer block for mounting on a connector, said block having at least one receptacle therein, said block including walls generally defining a cavity for receiving electrical terminals of the connector therein in order to allow electrical connection of the electrical terminals to said at least one first contact of said module housing;

at least one first electrical contact mounted in said module housing for electrical connection of a conductor thereto;

a bus bar mounted in said module housing, said bar electrically connected to said at least one electrical contact;

a grounding means for grounding the conductor thereto.

20. A connector interface assembly, comprising:

a module retainer block for mounting on a connector, said block having at least one receptacle therein, said block having walls defining a cavity;

a module housing for insertion into the at least one receptacle;

a plurality of first electrical sockets mounted in said module housing for receiving electrical conductors therein;

a bus bar mounted in a lower portion of said module housing, said bus bar electrically connected to said plurality of sockets;

a conductor retainer mounted at an upper portion of said module for retaining the conductors in said electrical socket;

a ground plate mounted on said retainer block, said ground plate generally positioned at the walls and generally within the cavity, said ground plate including an open area for receiving an electrical terminal portion of the connector.

21. A connector interface assembly, comprising:

a module retainer block for mounting on a connector, said block having at least one receptacle therein, said block having walls defining a cavity, said at least one receptacle being mounted at the walls;

a module housing for insertion into the at least one receptacle;

a plurality of first electrical sockets mounted in said module housing for receiving electrical conductors therein;

a bus bar mounted in a lower portion of said module housing, said bus bar electrically connected to said plurality of sockets;

a conductor retainer mounted at an upper portion of said module for retaining the conductors in said electrical socket;

a ground plate mounted on said retainer block, said ground plate generally positioned at the walls and generally within the cavity.

* * * * *